US007458918B1

(12) United States Patent
Clark

(10) Patent No.: US 7,458,918 B1
(45) Date of Patent: Dec. 2, 2008

(54) BACK SUPPORT FOR AN EXERCISE DEVICE

(75) Inventor: Michael R. Clark, Wadsworth, OH (US)

(73) Assignee: Fitness Quest Inc., Canton, OH (US)

( * ) Notice: Subject to any disclaimer, the term of this patent is extended or adjusted under 35 U.S.C. 154(b) by 563 days.

(21) Appl. No.: 10/994,875

(22) Filed: Nov. 22, 2004

Related U.S. Application Data

(60) Provisional application No. 60/524,139, filed on Nov. 21, 2003.

(51) Int. Cl.
*A63B 22/06* (2006.01)

(52) U.S. Cl. ..... 482/57; 297/452.13

(58) Field of Classification Search ..... 482/51, 482/53, 57, 61, 62, 142, 148; 601/34–36; 264/257; 297/452.13, 452.29, 453.63, 453.64, 297/440.11, 45.63, 452.64, 440.112
See application file for complete search history.

(56) References Cited

U.S. PATENT DOCUMENTS

| | | | |
|---|---|---|---|
| 4,002,108 | A | 1/1977 | Drori |
| 4,009,856 | A | 3/1977 | Wolters et al. |
| 4,072,344 | A | 2/1978 | Li |
| 4,084,775 | A | 4/1978 | Pelly |
| 4,189,180 | A | 2/1980 | Klein |
| 4,195,640 | A | 4/1980 | Castiglia |
| 4,207,635 | A | 6/1980 | Leroy |
| 4,207,879 | A | 6/1980 | Safadago et al. |
| 4,266,794 | A | 5/1981 | Bals |
| 4,299,645 | A | 11/1981 | Newsom |
| 4,302,048 | A | 11/1981 | Yount |
| 4,339,488 | A | 7/1982 | Brokmann |
| 4,349,195 | A | 9/1982 | Johnston |
| 4,411,421 | A | 10/1983 | Hershberger |
| 4,509,792 | A | 4/1985 | Wang |
| 4,529,246 | A | 7/1985 | Leib |
| 4,529,247 | A | 7/1985 | Stumpf et al. |
| 4,555,139 | A | 11/1985 | Leib |
| 4,556,254 | A | 12/1985 | Roberts |
| 4,618,144 | A | 10/1986 | Gibson |
| 4,639,042 | A | 1/1987 | Lange |
| D289,120 | S | 4/1987 | Chadwick et al. |
| 4,718,716 | A | 1/1988 | Stumpf et al. |
| D295,347 | S | 4/1988 | Chadwick et al. |
| D296,394 | S | 6/1988 | Chadwick et al. |
| D296,623 | S | 7/1988 | Chadwick et al. |
| 4,756,523 | A | 7/1988 | Rasmussen |

(Continued)

OTHER PUBLICATIONS

Leaflet from The Quantum Group Inc.—2 pages.

*Primary Examiner*—LoAn H. Thanh
*Assistant Examiner*—Tam Nguyen
(74) *Attorney, Agent, or Firm*—Brouse McDowell; Heather M. Barnes

(57) ABSTRACT

A support for an exercise device includes a frame having a top, a bottom, and two lateral sides extending between the top and the bottom. The frame has a channel defined about an interior perimeter. The top, the bottom and the two lateral sides define an opening. The frame has a body support integrally formed with the frame. The body support is formed by a lower arcuate portion of each of the two lateral sides. A membrane is operatively connected to a carrier. The carrier is adapted to attach to the frame via the channel, and the membrane having a first side and a second side.

5 Claims, 6 Drawing Sheets

U.S. PATENT DOCUMENTS 4,777,678 A 10/1988 Moore
D298,289 S 11/1988 Stumpf
4,793,608 A 12/1988 Mahnke et al.
D299,192 S 1/1989 Chadwick et al.
4,798,379 A 1/1989 Jenkins
4,798,395 A 1/1989 Shaffer et al.
4,842,268 A 6/1989 Jenkins
4,869,554 A 9/1989 Abu-Isa et al.
4,876,835 A 10/1989 Kelley et al.
4,913,495 A 4/1990 Nagasaka et al.
5,015,034 A 5/1991 Kindig et al.
5,038,539 A 8/1991 Kelley et al.
5,054,317 A 10/1991 Laubscher
5,086,597 A 2/1992 Kelley et al.
D331,630 S 12/1992 Stumpf
5,235,714 A 8/1993 Toso
5,295,949 A 3/1994 Hathaway
D346,279 S 4/1994 Stumpf et al.
5,445,583 A 8/1995 Habing
5,560,683 A 10/1996 Penley et al.
5,569,140 A 10/1996 Elliman
5,580,338 A 12/1996 Scelta et al.
D377,431 S 1/1997 Stumpf et al.
5,599,261 A 2/1997 Easley et al.
5,658,223 A * 8/1997 Habing et al. ..... 482/53
D386,023 S 11/1997 Stumpf et al.
5,762,592 A 6/1998 Neveux
5,765,804 A 6/1998 Stumpf et al.
5,772,282 A 6/1998 Stumpf et al.
5,785,669 A 7/1998 Proctor et al.
5,803,884 A 9/1998 Sharp
5,857,226 A 1/1999 Sommer
5,857,948 A 1/1999 Barnett
D412,406 S 8/1999 Stumpf et al.
D412,625 S 8/1999 Montague, III et al.
5,931,768 A 8/1999 Amesquita
D420,523 S 2/2000 Stumpf et al.
6,035,901 A 3/2000 Stumpf et al.
6,048,253 A 4/2000 Larsen
6,059,368 A 5/2000 Stumpf et al.
6,123,342 A 9/2000 Grell
6,125,521 A 10/2000 Stumpf et al.
6,145,925 A 11/2000 Eksin et al.
6,189,966 B1 2/2001 Faust et al.
6,196,627 B1 3/2001 Faust et al.
6,213,924 B1 4/2001 Kaiyoorawongs
6,312,366 B1 11/2001 Prusick
6,319,180 B1 11/2001 Kallassy
6,386,634 B1 5/2002 Stumpf et al.
6,409,635 B1 * 6/2002 Maresh et al. ..... 482/57
6,409,640 B2 6/2002 Cournoyer
6,428,105 B1 8/2002 Ellis et al.
6,439,665 B1 8/2002 Cvek
6,440,046 B1 8/2002 Tholkes
6,485,443 B1 11/2002 Garth
6,540,707 B1 4/2003 Stark et al.
6,540,950 B1 * 4/2003 Coffield ..... 264/257
6,551,219 B1 4/2003 Brown
6,572,190 B2 * 6/2003 Koepke et al. ..... 297/284.1
6,588,842 B2 7/2003 Stumpf et al.
6,623,079 B2 * 9/2003 Gregory ..... 297/440.11
6,669,292 B2 * 12/2003 Koepke et al. ..... 297/300.2
6,702,390 B2 * 3/2004 Stumpf et al. ..... 297/452.56
6,790,162 B1 * 9/2004 Ellis et al. ..... 482/51
6,848,744 B1 * 2/2005 Raftery et al. ..... 297/284.1
2001/0030457 A1 * 10/2001 Gregory ..... 297/440.11
2005/0062323 A1 * 3/2005 Dicks ..... 297/284.4

* cited by examiner

BACK SUPPORT FOR AN EXERCISE DEVICE

This application claims priority from a provisional patent application having Ser. No. 60/524,139, which was filed on Nov. 21, 2003.

I. BACKGROUND OF THE INVENTION

A. Field of Invention

This invention pertains to the art of methods and apparatuses for exercise devices, and more specifically to a mesh back support having an adjustable lumbar support.

B. Description of the Related Art

It is well established that proper diet and exercise are essential for a healthy lifestyle. During a cardiovascular exercise routine, the heart rate increases, which in turn causes a person's internal body temperature to rise. In order to cool itself off, the body perspires. While exercise devices provide fun and innovative ways to enjoy a work-out, it is desirable to have air circulation about areas of the exercise device that directly contact a person's body. Currently, the back and seat supports of exercise devices are fabricated from a poly-vinyl material, which serves as a cover over a foam cushion. This inhibits air circulation. Further, these back and seat supports are generally planar, so they do not provide the proper support to the lumbar area of the person's back. Further, by using a planar configuration with a seat support, it is common for a person to feel a tingling sensation in the mid-thigh area if a person's legs are not supported properly.

Based upon the foregoing, there is a need in the art for a support device to be used with exercise equipment that provides for increased air circulation and increased support to the body. The present invention provides for an exercise device having a mesh back support with an adjustable lumbar support.

II. SUMMARY OF THE INVENTION

According to one aspect of the present invention, a new and improved support for an exercise device is provided. The support for an exercise device includes a frame having a top, a bottom, and two lateral sides extending between the top and the bottom. The frame has a channel defined about an interior perimeter. The top, the bottom and the two lateral sides define an opening. The frame has a body support integrally formed with the frame. The body support is formed by a lower arcuate portion of each of the two lateral sides. A membrane is operatively connected to a carrier. The carrier is adapted to attach to the frame via the channel, and the membrane having a first side and a second side.

Another object of the present invention is to provide a back support that may support the lumbar area of the user.

Another object of the present invention is to provide a back support that may have a spaced relationship with the adjustment mechanism of the lumbar support such that sufficient air flows between the mesh and the adjusting means so as to aid the evaporation of perspiration.

Another object of the present invention is to provide a support apparatus for an exercise device, wherein the membrane may be adapted to stretch as the carrier attaches to the frame via the channel.

Another object of the present invention is to provide a support apparatus for an exercise device, which may further comprise:

an adjustment mechanism operatively connected to the frame, the adjustment mechanism adapted to move the frame relative to an associated member such that the body support is positioned to a preferred location to provide support to an associated operator's body, the adjustment mechanism being in a spaced relationship with the second side of the membrane such that air can circulate.

Another object of the present invention is to provide a support apparatus for an exercise device, wherein the support apparatus may be a back support, the body support is a lumbar support.

Another object of the present invention is to provide a support apparatus for an exercise device, wherein the support apparatus may be a seat, the body support may be adapted to support an associated operator's legs.

Another object of the present invention is to provide a support apparatus for an exercise device, wherein the frame may further comprise a cross member extending between the two lateral sides, the cross member having a central base portion and two oppositely disposed forked portions extending from the base portion and attaching to the two lateral sides.

Another object of the present invention is to provide a support apparatus for an exercise device, wherein the two oppositely disposed forked portions may be integrally formed with the base portion.

Another object of the present invention is to provide a support apparatus for an exercise device, wherein the adjustment mechanism may comprise:

a first bracket;

a second bracket operatively connected to the first bracket, the first bracket operatively connected to the frame, the second bracket having a bore defined therein, the second bracket adapted to receive the member, the second bracket having a sidewall and at least one hole defined in the sidewall; and a pin is adapted to be received in the hole defined in the sidewall in order to secure the adjustment mechanism to the member.

Another object of the present invention is to provide a support apparatus for an exercise device, wherein the exercise device may be a recumbent bicycle.

Another object of the present invention is to provide an exercise device, which may comprise:

a frame;

a horizontal support member operatively connected to the frame;

a sub-frame selectively movable relative to the horizontal support member;

a seat; and, a back support, the back support comprising a frame having a top, a bottom, and two lateral sides extending between the top and said bottom, the frame having a channel defined about an interior perimeter, the top, the bottom and the two lateral sides defining an opening, the frame having a body support integrally formed with the frame, the body support formed by a lower arcuate portion of each of the two lateral sides; and, a mesh fabric operatively connected to a carrier, the carrier adapted to attach to the frame via said channel, the mesh fabric having a first side and a second side.

Another object of the present invention is to provide an exercise device, wherein the sub-frame may further comprise:

a horizontal bracket, wherein the seat operatively connects to the horizontal support member, the horizontal bracket adapted to be selectively movable relative to the horizontal support member; and an upwardly extending member, wherein the back support operatively connects to the upwardly extending vertical member.

Another object of the present invention is to provide an exercise device, wherein the upwardly extending member and the horizontal member may define an angle α therebetween, the angle α ranging from about 100 degrees to about 140 degrees.

Another object of the present invention is to provide an exercise device, wherein the angle α may be about 120 degrees.

Another object of the present invention is to provide an exercise device, wherein the horizontal support member may further comprise a plurality of holes defined therein, the horizontal bracket having at least one hole defined therein, wherein a pin may be adapted to pass through the hole of the horizontal bracket and one of the holes of the horizontal support member to selectively secure the sub-frame.

Another object of the present invention is to provide an exercise device, wherein the upwardly extending member may have a bore defined therein, the upwardly extending member also having at least one sidewall with a plurality of holes defined therein.

Another object of the present invention is to provide an exercise device, wherein the back support may further comprise an adjustment mechanism operatively connected to the back support frame, the adjustment mechanism adapted to move the back support frame relative to the upwardly extending member such that the back support is positioned to a preferred location to provide support to an associated operator's lumbar area, the adjustment mechanism being in a spaced relationship with the second side of the membrane such that air can circulate.

Another object of the present invention is to provide an exercise device, wherein the back support frame may further comprise a cross member extending between the two lateral sides, the cross member having a central base portion and two oppositely disposed forked portions extending from the base portion and attaching to the two lateral sides.

Another object of the present invention is to provide an exercise device, wherein the sub-frame may further comprise a planar attachment bracket angularly connected to the horizontal bracket, the seat adapted to attach to the planar attachment bracket.

Another object of the present invention is to provide a recumbent bicycle, which may comprise:

a frame;

a pedal assembly rotatably connected to the frame;

a horizontal support member operatively connected to the frame;

a seat;

a sub-frame selectively movable relative to the horizontal support member, the sub-frame further comprises a horizontal bracket and an upwardly extending member, wherein the seat operatively connects to the horizontal support member, the horizontal bracket adapted to be selectively movable relative to the horizontal support member; wherein the back support operatively connects to the upwardly extending vertical member; and, a back support, the back support comprising a frame having a top, a bottom, and two lateral sides extending between the top and the bottom, the frame having a channel defined about an interior perimeter, the top, the bottom and the two lateral sides defining an opening, the frame having a body support integrally formed with the frame, the body support formed by a lower arcuate portion of each of the two lateral sides; a mesh fabric operatively connected to a carrier, the carrier adapted to attach to the frame via the channel, the mesh fabric having a first side and a second side; wherein the back support further comprises an adjustment mechanism operatively connected to the back support frame, the adjustment mechanism adapted to selectively move the back support frame relative to the upwardly extending member such that the back support is positioned to a preferred location to provide support to an associated operator's lumbar area, the adjustment mechanism being in a spaced relationship with the second side of the membrane such that air can circulate;

wherein the horizontal support member further comprises a plurality of holes defined therein, the horizontal bracket having at least one hole defined therein, wherein a pin is adapted to pass through the hole of the horizontal bracket and one of the holes of the horizontal support member to selectively secure the sub-frame to the horizontal support member, wherein the upwardly extending member has a bore defined therein, the upwardly extending member also having at least one sidewall with a plurality of holes defined therein, wherein the back support frame further comprises a cross member extending between the two lateral sides, the cross member having a central base portion and two oppositely disposed forked portions extending from the base portion and attaching to the two lateral sides.

Still other benefits and advantages of the invention will become apparent to those skilled in the art to which it pertains upon a reading and understanding of the following detailed specification.

III. BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

IV. DESCRIPTION OF THE PREFERRED EMBODIMENT

Figure 1:
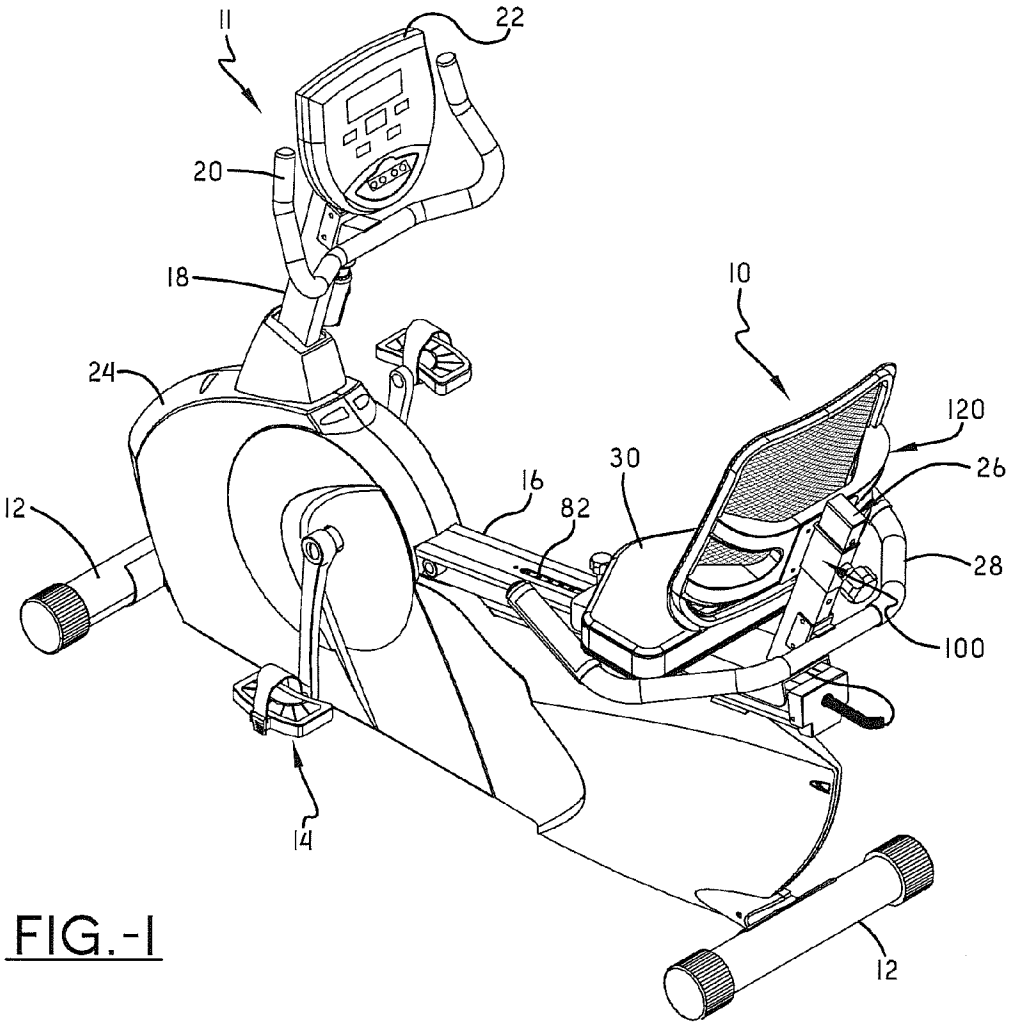
FIG. 1 is a perspective view of the present invention as used on the recumbent bicycle.

Referring now to the drawings wherein the showings are for purposes of illustrating a preferred embodiment of the invention only and not for purposes of limiting the same, FIGS. 1-15 show the present invention.

The present invention is a support apparatus, such as a back support 10, which may be used on an exercise apparatus 11, such as a recumbent bicycle, but not limited thereto. As shown in FIG. 1, the exercise apparatus 11 may include a frame 12 and a pedal assembly 14 rotatably connected to the frame 12. A horizontal support member 16 is operatively connected to the frame. A front post 18 extends from the front portion of the frame 12, which may include handlebars 20 and a console 22, which may record speed, travel distance, calories burned, heart rate, etc. A shroud 24 is shown which covers the pedal assembly 14 as well as the other moving components (not shown). A sub-frame 26 is operatively connected to the horizontal support member 16. Further, a second set of handlebars 28 may encircle the sub-frame 26. The sub-frame 26 may be selectively moveable relative to the horizontal support member 16, namely, in the fore and aft direction. A seat 30 and the back support 10 may both operatively connect to the sub-frame 26 as shown in the FIGURES.

With reference to FIGS. 2-7, the support apparatus 10 is shown in further detail. The support apparatus 10 may include a frame 40 having a top 42, a bottom 44, and two lateral sides 46 extending between the top 42 and the bottom 44. The frame 40 may have a channel 48 defined about an interior perimeter 50 of the frame 40. The top 42, the bottom 44, 40 and the two lateral sides 46 of the frame define an opening 52. A membrane 54 or mesh fabric is operatively connected to a carrier 56, which is adapted to attach to the frame 40 via the channel 48. The membrane 54 has a first side 58 and a second side 60.

With continuing reference to FIGS. 2-7, the frame 40 forms a body support 62, which is formed by a lower arcuate portion 64 of each of the two lateral sides 46. The membrane 54 is adapted to stretch with the carrier 56 attaches to the frame 40 via the channel 48.

With reference to FIGS. 8-11, the sub-frame 26 will now be described in more detail. The sub-frame 26 further comprises a horizontal bracket 70. The seat 30 connects to the horizontal bracket 70 via a planar attachment bracket 72, which is angularly connected to the horizontal bracket 70. The horizontal bracket 70 has a base portion 74 and two side flanges 76 extending perpendicularly therefrom. The side flanges 76 and base portion 74 form a U-shaped cross-section. Of course, any other cross-section may be chosen with sound engineering judgment. The horizontal bracket 70 is adapted to be selectively moveable relative to the horizontal support member 16.

Figure 11:
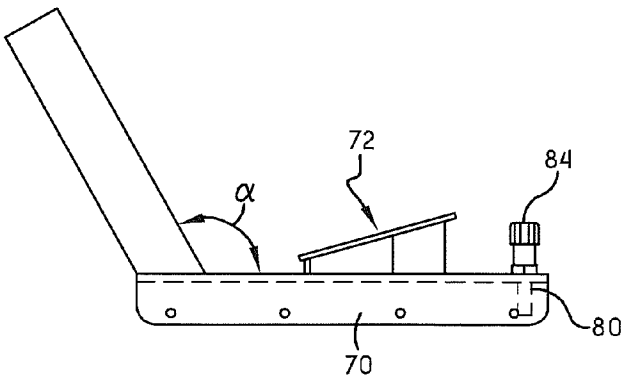
FIG. 11 is a front elevational view of FIG. 8.
Figure 9:
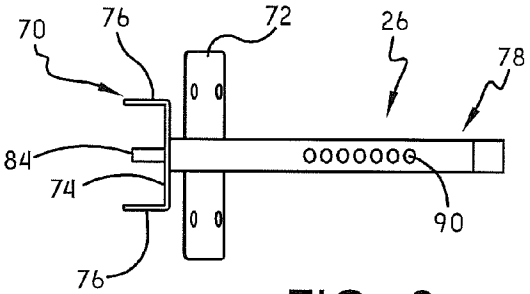
FIG. 9 is a top left side view of FIG. 8.
Figure 8:
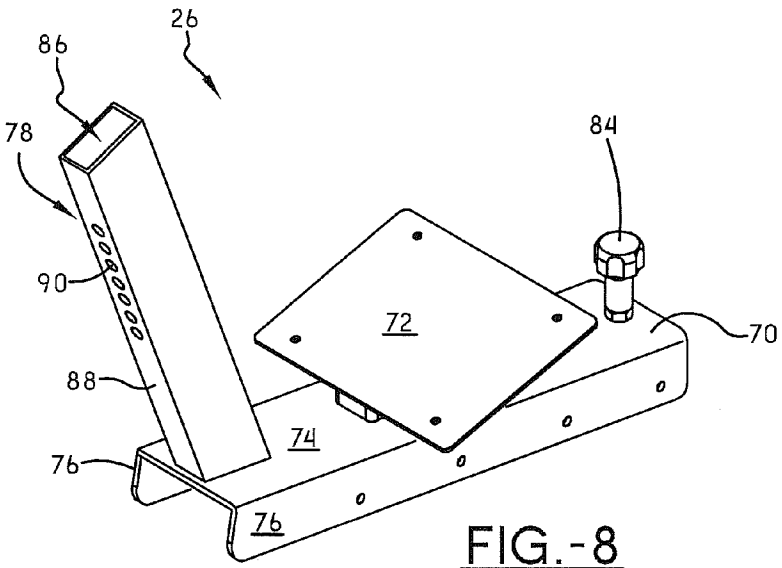
FIG. 8 is a perspective view of the sub-frame.
Figure 12:
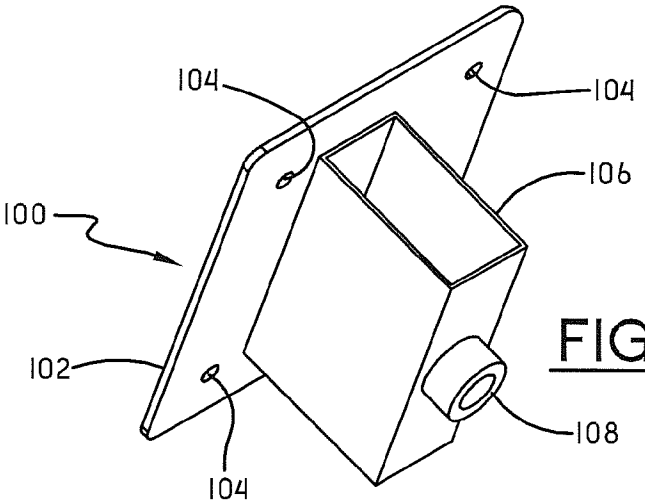
FIG. 12 is a perspective view of an attachment mechanism.
Figure 15:
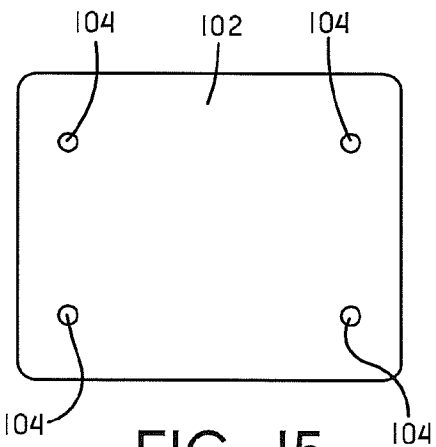
FIG. 15 is a rear elevational view of FIG. 12.
Figure 14:
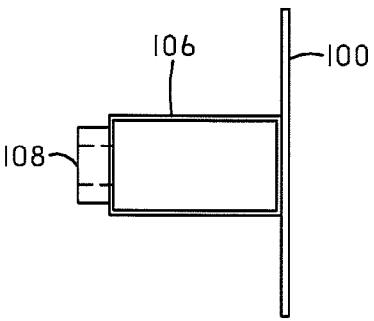
FIG. 14 is a top view of FIG. 12.
Figure 13:
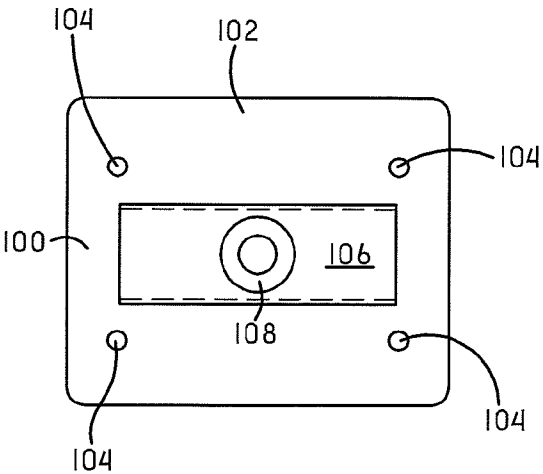
FIG. 13 is a side elevational view of FIG. 12.

With continuing reference to FIGS. 8-11, an upwardly extending member 78 is connected to the horizontal bracket 70. The support apparatus 10, and in this embodiment the back support 10, operatively connects to the upwardly extending vertical member 78. As shown in FIG. 11, the upwardly extending member 78 and the horizontal bracket 70 define an angle $\alpha$ therebetween. Generally the angle may range anywhere from about 100 degrees to about 140 degrees, and preferably, angle $\alpha$ is about 120 degrees. This angle provides a more comfortable seating position for the user. The horizontal support bracket 70 has at least one hole 80 defined therein. The horizontal support member 16 further comprises a plurality of holes 82, as shown in FIG. 1. A pin 84 is adapted to pass through the hole 80 of the horizontal bracket 70 and one of the holes 82 of the horizontal support member 16 to selectively secure the sub-frame 26 to the horizontal support member 16. The upwardly extending member 78 may be adapted to move in the horizontal direction with horizontal bracket 70. The upwardly extending member 78 may have a bore 86 defined therein. As shown in the FIGURES, the upwardly extending member 78 may be square or rectangular in cross-section, but this is not required. Any cross-section chosen in accordance with sound engineering judgment may be chosen. The upwardly extending member 78 has at least one sidewall 88 having a plurality of holes 90 defined therein. This configuration enables the support apparatus 10 to be adjusted in a vertical direction as will be described in more detail below.

With reference to FIGS. 12-15, an adjustment mechanism 100 is shown. The adjustment mechanism 100 operatively connects to the frame 40 of the support apparatus 10. It is adapted to move relative to an associated member, such as the upwardly extending member 78 as previously described. As such, the body support 62 may be positioned to a preferred location to provide support to an operator's body, namely in the lumbar area. The adjustment mechanism 100 is in a spaced relationship with the second side 60 of the membrane 54 such that air can better circulate.

As shown in FIGS. 8-15, the adjustment mechanism 100 comprises a plate 102 with holes 104 for fasteners, such as a washer and screw. Any other attachment may be utilized with sound engineering judgment, such as bolts, and the same holes may be utilized. A square tube 106 is attached to the plate 102 via welding or any other means chosen with sound engineering judgment. Also, any other cross-section may be chosen with sound engineering judgment, such as a square, a circle, or other polygonal shape. A collar 108 is operatively connected to the square tube 106.

Figure 2:
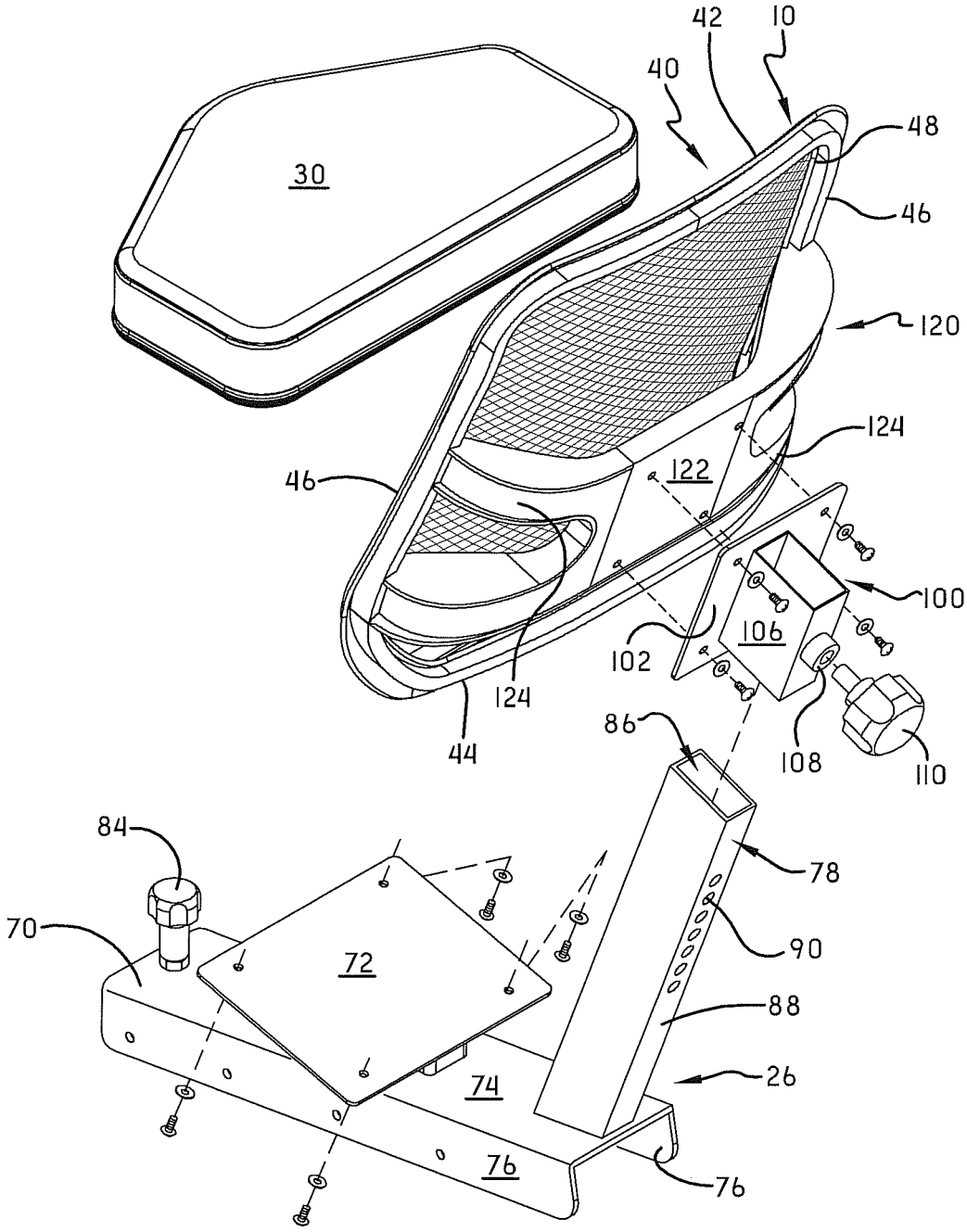
FIG. 2 is an exploded perspective view of the sub-frame assembly of the present invention.
Figure 4:
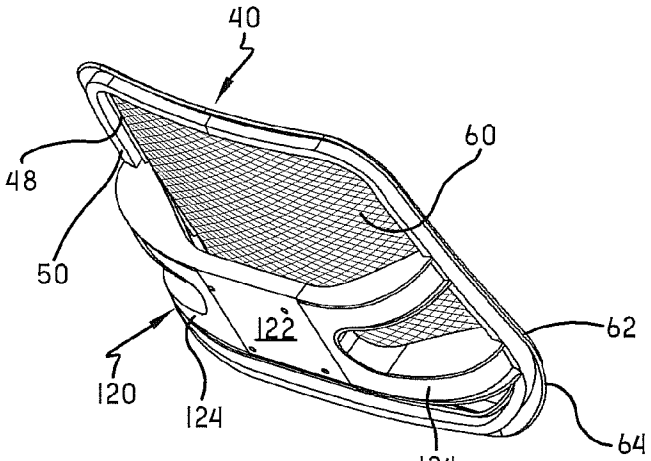
FIG. 4 is a rear perspective view of the back support.
Figure 3:
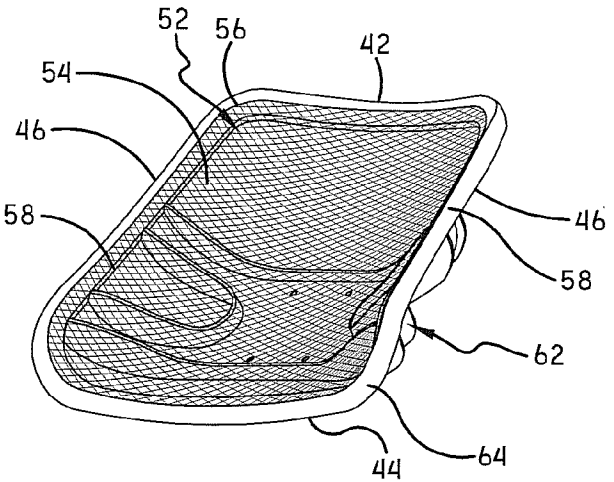
FIG. 3 is a front perspective view of the back support.
Figure 4A:
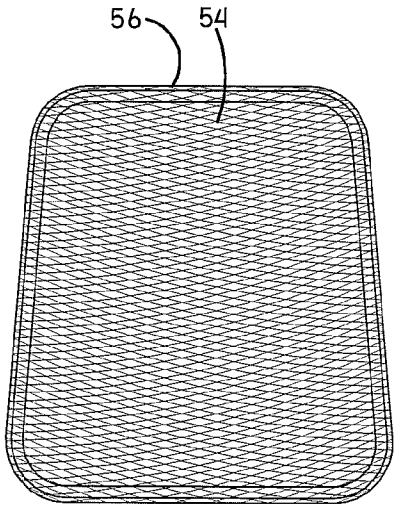
FIG. 4A is a front elevational view of the mesh in a carrier.
Figure 6:
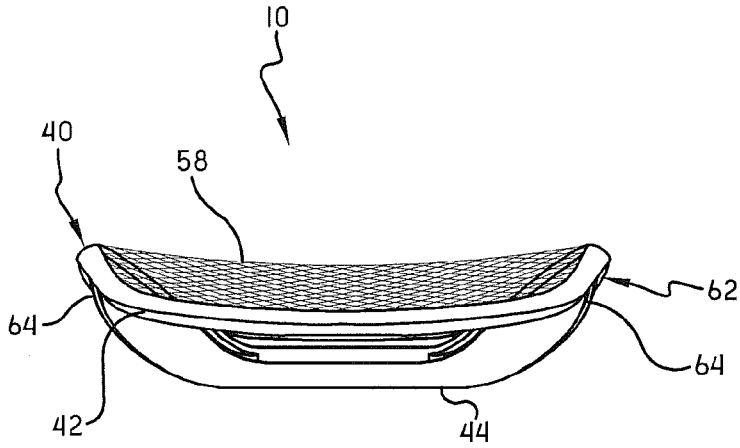
FIG. 6 is a top view of FIG. 5.
Figure 5:
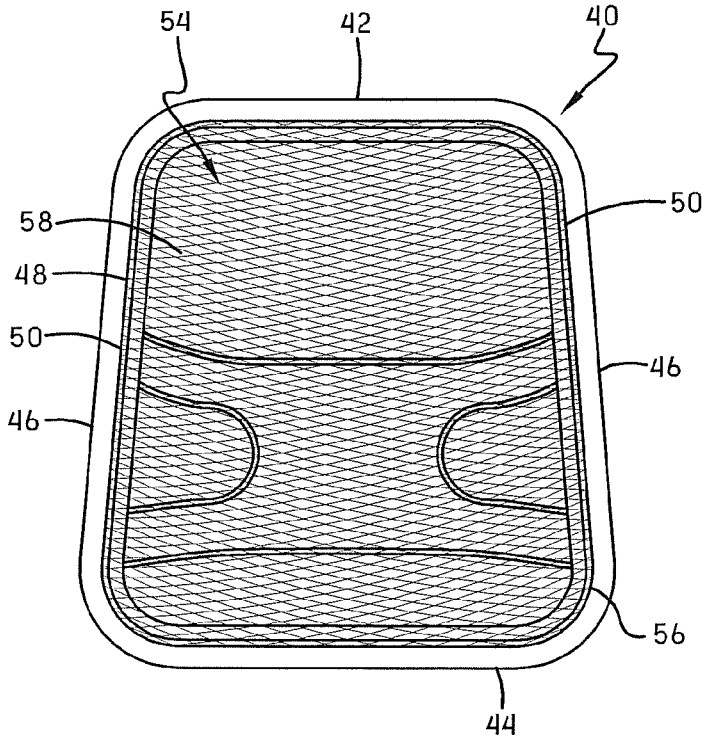
FIG. 5 is a front elevational view of the back support.
Figure 7:
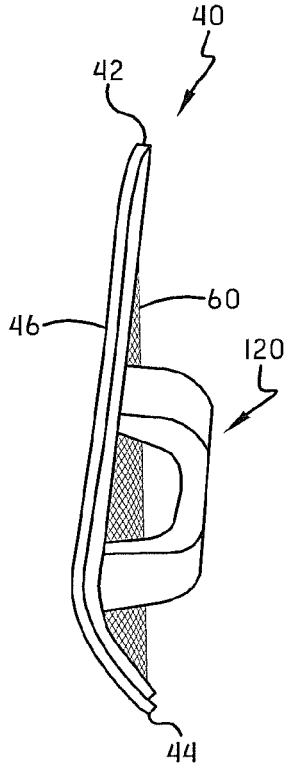
FIG. 7 is a right side view of FIG. 5.
Figure 10:
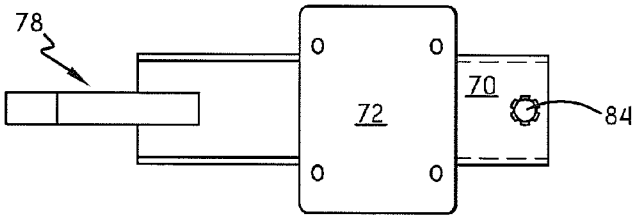
FIG. 10 is a top view of FIG. 8.

With reference now to FIGS. 1, 2, and 4, the support apparatus 10 further comprises a cross-member 120 extending between the two lateral sides 46 of the support apparatus frame 40. The cross-member 120 has a central base portion 122 and two oppositely disposed fork portions 124 extending from the base portion 122 and attaching to the two lateral sides 46. The two oppositely disposed fork portions 124 may be integrally formed with the base portion. As shown in FIG. 2, the plate 102 of the adjustment mechanism 100 is adapted to mate with the central base portion 122 of the cross-member 120. This provides adequate engagement of the adjustment mechanism 100 to the back support 10. As such, the back support may be moved in a vertical direction in order to adjust the body support 62 to the user's lumbar area. In order to move the back support 10, the pin 110 is loosened. The back support is adjusted vertically along the upwardly extending member 78. Once the desired position is reached, the pin 110 is turned within the collar 108 and goes through the hole of the square tubing 106 and engages one of the holes 90 of the upwardly extending member 78. The pin 110 may then be tightened to secure the back support 10 in place.

In another embodiment of the present invention, the support apparatus 10 may be a seat. In this embodiment the body support 60 may contact the user's legs a few inches above the knee. By providing the curved support in this area, circulation is maintained and the legs do not "fall asleep" or get a tingling sensation due to inhibited circulation.

The preferred embodiments have been described, hereinabove. It will be apparent to those skilled in the art that the above methods may incorporate changes and modifications without departing from the general scope of this invention. It is intended to include all such modifications and alterations in so far as they come within the scope of the appended claims or the equivalents thereof.

What is claimed is:

1. An exercise apparatus comprising:

a stationary frame, a horizontal support member operatively connected to said frame;

a sub-frame selectively movable fore and aft relative to said horizontal support member;

a seat; and, a back support said back support comprising a back support frame having a top, a bottom and two lateral sides extending between said top and said bottom said back support frame, said top, said bottom and said two lateral sides defining an opening, said back support frame having a body support integrally formed with said back support frame, said body support formed by a lower arcuate portion of each of said two lateral sides; and, a mesh fabric membrane operatively connected to a carrier said carrier operatively connected to said back support frame to cover said opening of said back support, same mesh fabric membrane having a first side and a second side;

wherein said sub-frame further comprises:

a horizontal bracket, wherein said seat operatively connects to said horizontal bracket, said horizontal bracket adapted to be selectively movable relative to said horizontal support member; and, an upwardly extending member, wherein said back support operatively connects to said upwardly extending vertical member;

wherein said horizontal support member further comprises a plurality of holes defined therein, said horizontal bracket having at least one hole defined therein, wherein a pin is adapted to pass through the hole of the horizontal bracket and one of the holes of the horizontal support member to selectively secure said sub-frame to the horizontal support member;

wherein said upwardly extending member has a bore defined therein, said upwardly extending member also having at least one sidewall with a plurality of holes defined therein;

wherein said back support further comprises an adjustment mechanism operatively connected to said back support frame, said adjustment mechanism adapted to move said back support frame relative to said upwardly extending member such that the back support is positioned to a preferred location to provide support to an user's lumbar area, said adjustment mechanism being in a spaced relationship with said second side of said membrane such that air can circulate there between, said adjustment mechanism having a plate, a polygonal member attached to said plate, and a pin extending through said polygonal member and one of said plurality of holes of the upwardly extending member such that the back support is adjustably movable along said upwardly extending member.

2. The exercise apparatus of claim 1, wherein said back support frame further comprises a cross member extending between said two lateral sides, said cross member having a central base portion and two oppositely disposed forked portions extending from said base portion and attaching to said two lateral sides, wherein said central base portion is adapted to mate with said plate, said pin is adapted to engage one of said holes of said upwardly extending member to secure said back support to said upwardly extending member.

3. The exercise apparatus of claim 1, wherein said sub-frame further comprises a planar attachment bracket angularly connected to said horizontal bracket, said seat adapted to attach to said planar attachment bracket.

4. The exercise apparatus of claim 3, wherein said exercise apparatus is a recumbent bicycle.

5. A recumbent bicycle, comprising:

a frame stationary;

a pedal assembly rotatably connected to said frame;

a horizontal support member operatively connected to said frame;

a seat;

a sub-frame selectively movable fore and aft relative to said horizontal support member, said sub-frame further comprises a horizontal bracket and an upwardly extending member, wherein said seat operatively connects to said horizontal support member, said horizontal bracket adapted to be selectively movable relative to said horizontal support member; and, a back support, said back support comprising a back support frame having a top, a bottom, and two lateral sides extending between said top and said bottom, said bottom and said two lateral sides defining an opening, said back support frame having a body support integrally formed with said back support frame, said body support formed by a lower arcuate portion of each of said two lateral sides; a mesh fabric membrane operatively connected to a carrier, said carrier is attached to said back support frame to cover said opening, said mesh fabric membrane having a first side and a second side; wherein said back support further comprises an adjustment mechanism operatively connected to said back support frame wherein said back support operatively connects to said upwardly extending vertical member, said adjustment mechanism selectively moves said back support frame relative to said upwardly extending member such that the back support is positioned to a preferred location to provide support to a user's lumbar area, said adjustment mechanism being in a spaced relationship with said second side of said membrane such that air can circulate there between;

wherein said horizontal support member further comprises a plurality of holes defined therein, said horizontal bracket having at least one hole defined therein, wherein a pin is adapted to pass through the hole of the horizontal bracket and one of the holes of the horizontal support member to selectively secure said sub-frame to said horizontal support member, wherein said upwardly extending member has a bore defined therein, said upwardly extending member also having at least one sidewall with a plurality of holes defined therein, wherein said back support frame further comprises a cross member extending between said two lateral sides, said cross member having a central base portion and two oppositely disposed forked portions extending from said base portion and attaching to said two lateral sides and said adjustment mechanism having a polygonal member and a pin extending through said polygonal member and one of said plurality of holes of the upwardly extending member such that the back support is adjustably movable along said upwardly extending member.

* * * * *